US008770939B2

(12) United States Patent
Tsukuda et al.

(10) Patent No.: US 8,770,939 B2
(45) Date of Patent: Jul. 8, 2014

(54) TURBINE ROTOR BLADE ASSEMBLY AND STEAM TURBINE

(75) Inventors: Tomohiko Tsukuda, Kawasaki (JP); Sakae Kawasaki, Yokohama (JP); Hiroshi Kawakami, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 867 days.

(21) Appl. No.: 12/833,347

(22) Filed: Jul. 9, 2010

(65) Prior Publication Data

US 2011/0008173 A1 Jan. 13, 2011

(30) Foreign Application Priority Data

Jul. 10, 2009 (JP) ..... P2009-163288

(51) Int. Cl.
*F01D 5/32* (2006.01)

(52) U.S. Cl.
USPC ..... 416/217

(58) Field of Classification Search
USPC ..... 416/222, 220 R, 215, 216, 218, 217
See application file for complete search history.

(56) References Cited

U.S. PATENT DOCUMENTS

| | | | | | |
|---|---|---|---|---|---|
| 1,390,733 | A | * | 9/1921 | Spiess | 415/185 |
| 2,036,083 | A | * | 3/1936 | Robinson | 416/213 R |
| 2,220,918 | A | * | 11/1940 | Smith | 416/191 |
| 2,844,355 | A | * | 7/1958 | Rankin | 416/216 |
| 3,826,592 | A | * | 7/1974 | Raboin | 416/222 |
| 4,702,673 | A | * | 10/1987 | Hansen et al. | 416/215 |
| 4,730,984 | A | * | 3/1988 | Ortolano | 416/222 |
| 5,509,784 | A | * | 4/1996 | Caruso et al. | 416/222 |
| 6,030,178 | A | * | 2/2000 | Caruso | 416/220 R |
| 2006/0127221 | A1 | * | 6/2006 | Yamashita et al. | 416/222 |
| 2009/0246029 | A1 | | 10/2009 | Saito et al. | |

FOREIGN PATENT DOCUMENTS

| | | | | |
|---|---|---|---|---|
| EP | 1 959 098 | A1 | 8/2008 | |
| EP | 1959098 | A1 * | 8/2008 | F01D 5/22 |
| JP | 10-103003 | A | 4/1998 | |
| JP | 2007-154695 | A | 6/2007 | |

* cited by examiner

*Primary Examiner* — Edward Landrum
*Assistant Examiner* — Joshua R Beebe
(74) *Attorney, Agent, or Firm* — Foley & Lardner LLP

(57) ABSTRACT

In a turbine rotor blade assembly 1, a length h2 in the radial direction of a bucket dovetail 15 of a notch blade 10 is configured to be shorter than a length h3 in the radial direction of an effective blade portion 13 of a adjacent notch blade 30 and a length h4 in the radial direction of the bucket dovetail 15. Thus, during an insertion of the notch blade 10 in the axial direction, the rotational movement Rf around the radial direction and the circumferential movement of the notch blade 10 can be secured.

8 Claims, 17 Drawing Sheets

TURBINE ROTOR BLADE ASSEMBLY AND STEAM TURBINE

CROSS-REFERENCE TO RELATED APPLICATION

This application is based upon and claims the benefit of priority from Japanese Patent Application No. 2009-163288, filed Jul. 10, 2009; the entire contents of which are incorporated herein by reference.

FIELD

Embodiments described herein relate generally to a turbine rotor blade assembly provided with a snubber cover (integral cover) formed integrally with blades on the blade tips and a steam turbine.

BACKGROUND

Generally, the turbine rotor blades often have the blade tips provided with a grouped blades structure in order to suppress generation of vibration or to prevent steam from leaking out of the blade tips during operation.

There is a grouped blades structure called as a tenon-shroud structure. This grouped blades structure, i.e. the tenon-shroud structure, comprises tenons, each of which is respectively provided with tip portion of each turbine rotor blades, and a cover that can be attached to the tenons by caulking or swaging. The tenon-shroud structure combines plural turbine rotor blades as a group by attaching the cover to the tenons.

Thus, the tenon-shroud structure, which is provided with plural turbine rotor blades at the tip portion, combines the plural turbine rotor blades into one group. When providing the tenon with the cover, however, it needs lots of time and effort for caulking or swaging work. In addition, the connected portions do not necessarily have enough strength. There is also another grouped blades structure so-called a snubber cover structure. With the snubber cover structure, each turbine rotor blades is provided with a snubber cover (integral cover) at tip ends integrally thereof. These integrally provided snubber covers of each turbine rotor blades connect all the turbine rotor blades circumferentially as a grouped blades.

In connection with the snubber cover structure, there have been disclosed lots of technologies studying on optimization of the cover shape, a degree of connection between the turbine rotor blade and the cover, a connection position and the like (see, for example, JP-A 10-103003 (hereinafter called Patent Reference 1) and JP-A 2007-154695 (hereinafter called Patent Reference 2)).

FIG. 18 is a plan view of an assembled turbine rotor blades 300 having a snubber cover structure viewed from the cover side, namely from radially outside with respect to the central axis (axial direction) of the turbine rotor.

Patent Reference 1 discloses turbine rotor blades 300 having a snubber cover structure, which are grouped by connecting by a cover, as shown in FIG. 18. The turbine rotor blade 300 having the snubber cover structure has a snubber cover 301, as the integral cover, which is integrally provided with the tip of the turbine rotor blade 300. And, a blade suction side 302 and a blade pressure side 303 of the snubber cover 301 are provided with overhanging portions 304 and 305 respectively toward a circumferential direction Cd with respect to the rotational axis of the turbine rotor. When the turbine rotor blades 300 are in an assembled state, the overhanging portion

304 and the overhanging portion 305 are strongly contacted between the adjacent turbine rotor blades 300 along a cover contact surface 308. Cover contact surface 308 intersects with an axial direction of the turbine rotor Ad that corresponds to a normal direction of cover contact surface 308. A reaction force is generated under the strong contact force, and the reaction force is used as frictional force to control vibration. This grouped blades structure is called a snubber cover structure because it controls vibration by using the reaction force as the frictional force.

According to the snubber cover structure, even when heat elongation due to thermal expansion or centrifugal force during the operation is generated in the radial direction, or the pitch of the adjacent snubber cover 301 tends to open by a difference in thermal expansion between the turbine wheel and the snubber cover 301, a positional relationship (interplanar distance) of the individual snubber covers 301 is not substantially affected because a frictional force acts on the cover contact surfaces 308 between the adjacent turbine rotor blades 300. Therefore, the turbine rotor blades 300 having the snubber cover structure can be applied to any turbine stages without limitations, regardless of the turbine rotor blades 300 having, for example, a variable blade length, a temperature difference, a difference in linear expansion coefficient among materials and the like. Patent Reference 2 discloses a turbine rotor blade that can control vibrations by assuring a contact reaction force between the snubber covers. FIG. 19 is a side view of a turbine rotor blade 310 having a twist lock structure.

The turbine rotor blade 310, as shown in FIG. 19, has a twist lock piece 312 (a protruded portion) formed on a bucket dovetail 311 of the turbine rotor blade 310. Bucket dovetail 311 is a portion for implanting the turbine rotor blade 310 to a rotor dovetail provided with the turbine rotor (i.e. turbine wheel 315). A turbine wheel 315, in which the turbine rotor blades 310 are implanted is formed with a twist-return restraint piece 316 (a cutout groove). Twist lock piece 312 is fitted to twist-return restraint piece 316.

The twist lock structure, comprising twist lock piece 312 and twist-return restraint piece 316, enables to stably and surely secure the contact reaction force of the cover contact surface of the snubber cover structure. Since the twist lock structure surely prevents the snubber covers from making a twist return during operation, the circumferentially grouped structure of the turbine rotor blades can be secured.

DETAILED DESCRIPTION

When the turbine rotor blades having the above-described snubber cover structure are assembled by implanted, the notch blade interferes with its adjacent rotor blades (namely, adjacent notch blades) and the notch blade might not be implanted occasionally. The notch blade is a turbine rotor blade which is implanted last on the turbine rotor (turbine wheel) among the turbine rotor blades of the pertinent stage during its assembly. The notch blade is implanted by inserting between the previously assembled rotor blades, i.e. adjacent notch blades described above.

Especially, when the turbine rotor blade has an effective blade portion length smaller than an implant height, and a circumferential width of a snubber cover and a circumferential width of an effective blade width of the turbine rotor blade are relatively large with respect to a circumferential pitch, it is sometimes likely to encounter the above-described situation at the time of assembling the notch blade.

A method of assembling the notch blade is described below.

Figure 20:
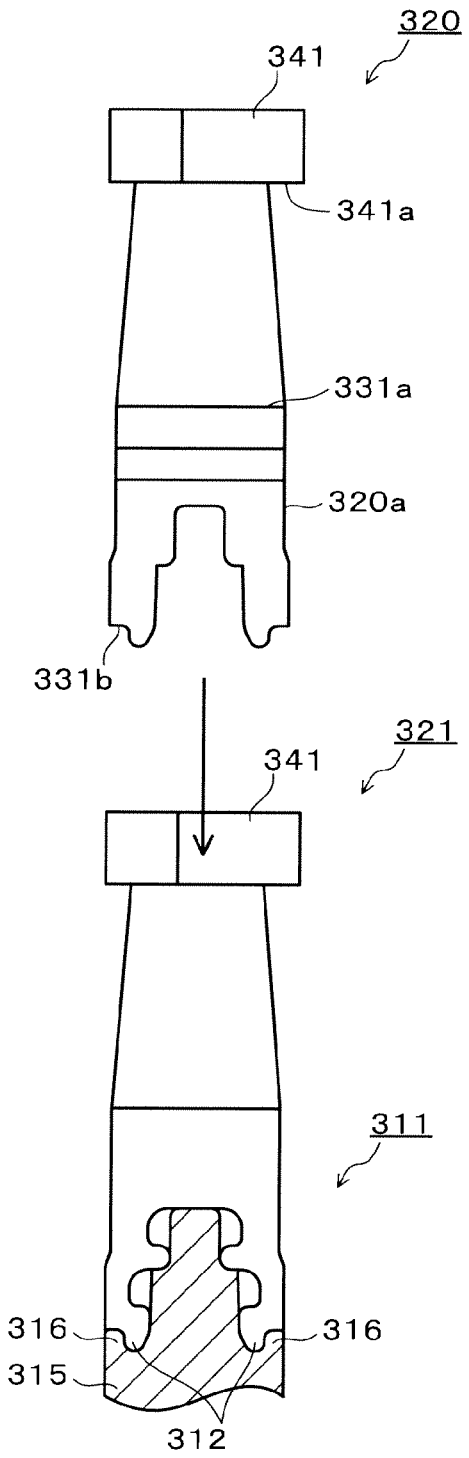
FIG. 20 is a plan view of a state of inserting a notch blade between turbine rotor blades having a snubber cover structure viewed from the circumferential direction of the turbine rotor.
Figure 21:
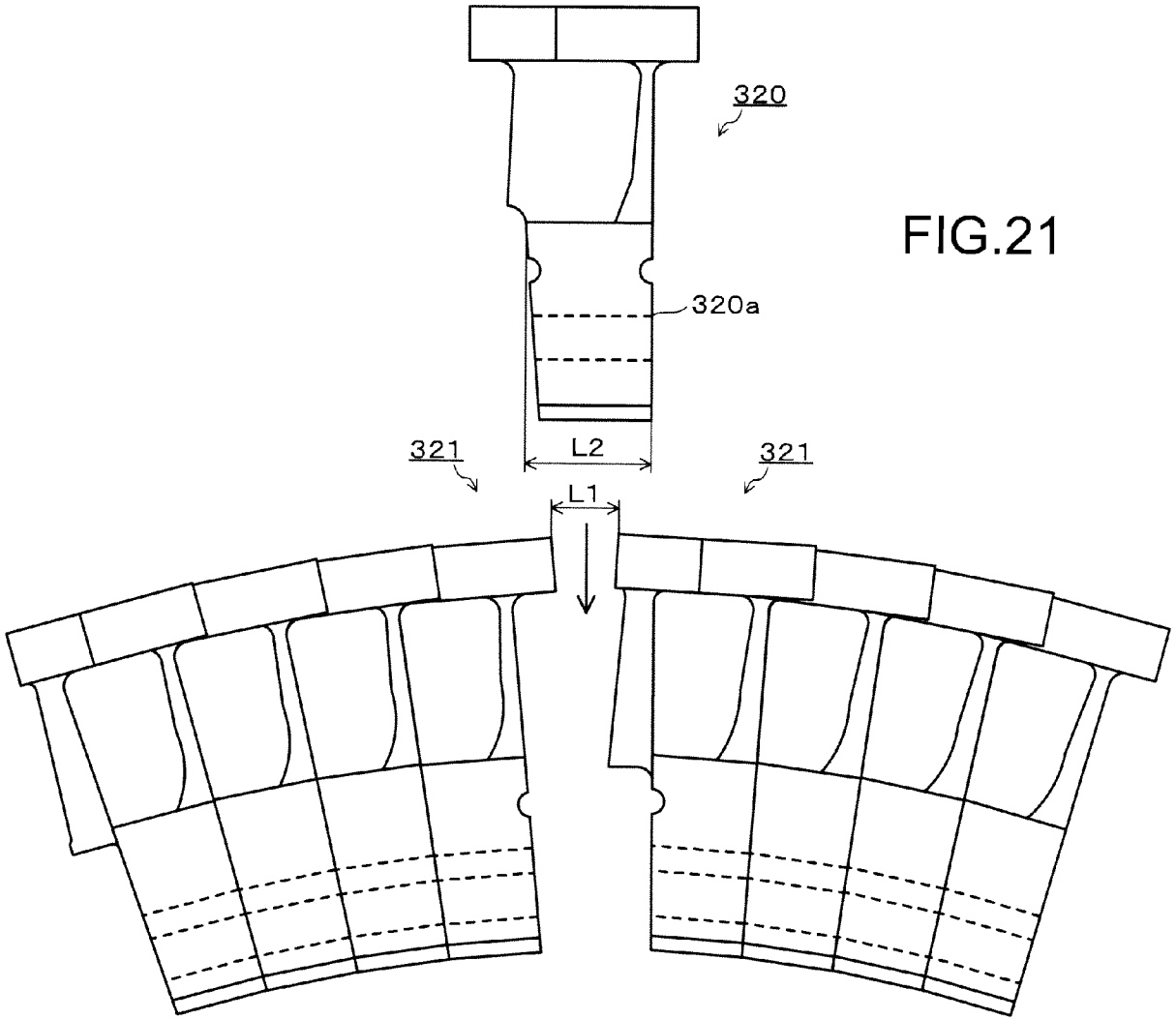
FIG. 21 is a plan view of a state of inserting a notch blade between the turbine rotor blades having a snubber cover structure viewed from the axial direction of the turbine rotor.
Figure 22:
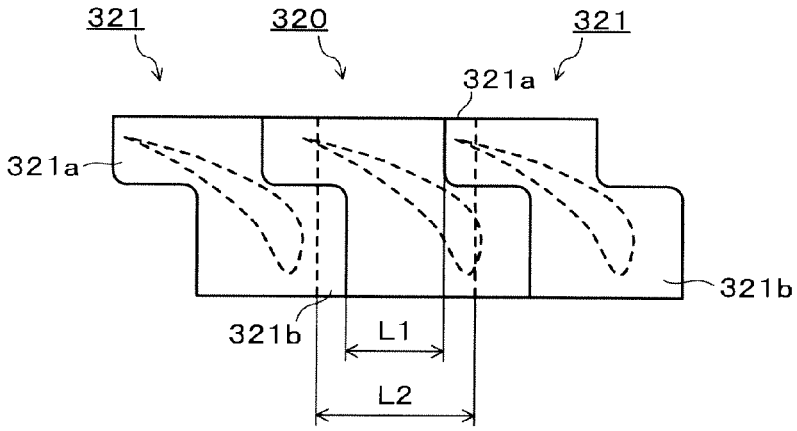
FIG. 22 is a plan view of a state of inserting a notch blade between turbine rotor blades having a snubber cover structure viewed from the cover side.

FIG. 20 is a plan view of a state of inserting a notch blade 320 between turbine rotor blades having the snubber cover structure viewed from the circumferential direction of the turbine rotor (namely, a sectional view including a rotational axis of the turbine rotor (meridional section view)). FIG. 21 is a plan view of a state of inserting the notch blade 320 between the turbine rotor blades having the snubber cover structure viewed from the axial direction of the turbine rotor. FIG. 22 is a plan view of a state of inserting the notch blade 320 between the turbine rotor blades having the snubber cover structure viewed from the cover side (radially outside to the turbine rotor axis).

As shown in FIG. 20 and FIG. 21, the notch blade 320 is vertically inserted from outside toward the center in a radial direction with respect to the rotational axis of the turbine rotor between adjacent notch blades 321. When a circumferential distance L1 between a pressure-side overhanging portion 321*a* of the adjacent notch blade 321 shown in FIG. 22 and a suction side overhanging portion 321*b* of the other adjacent notch blade 321 is shorter than a circumferential width L2 of a bucket dovetail 320*a* of the notch blade 320, the notch blade 320 cannot be inserted vertically from outside toward the center in the radial direction between the adjacent notch blades 321.

Figure 23:
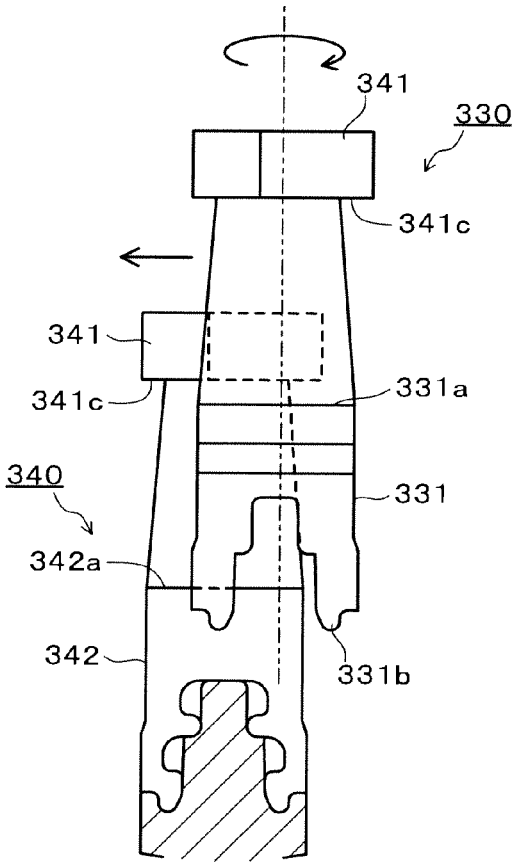
FIG. 23 is a plan view of a state of inserting the notch blade on the turbine rotor blade having a snubber cover structure viewed from the circumferential direction of the turbine rotor.
Figure 24:
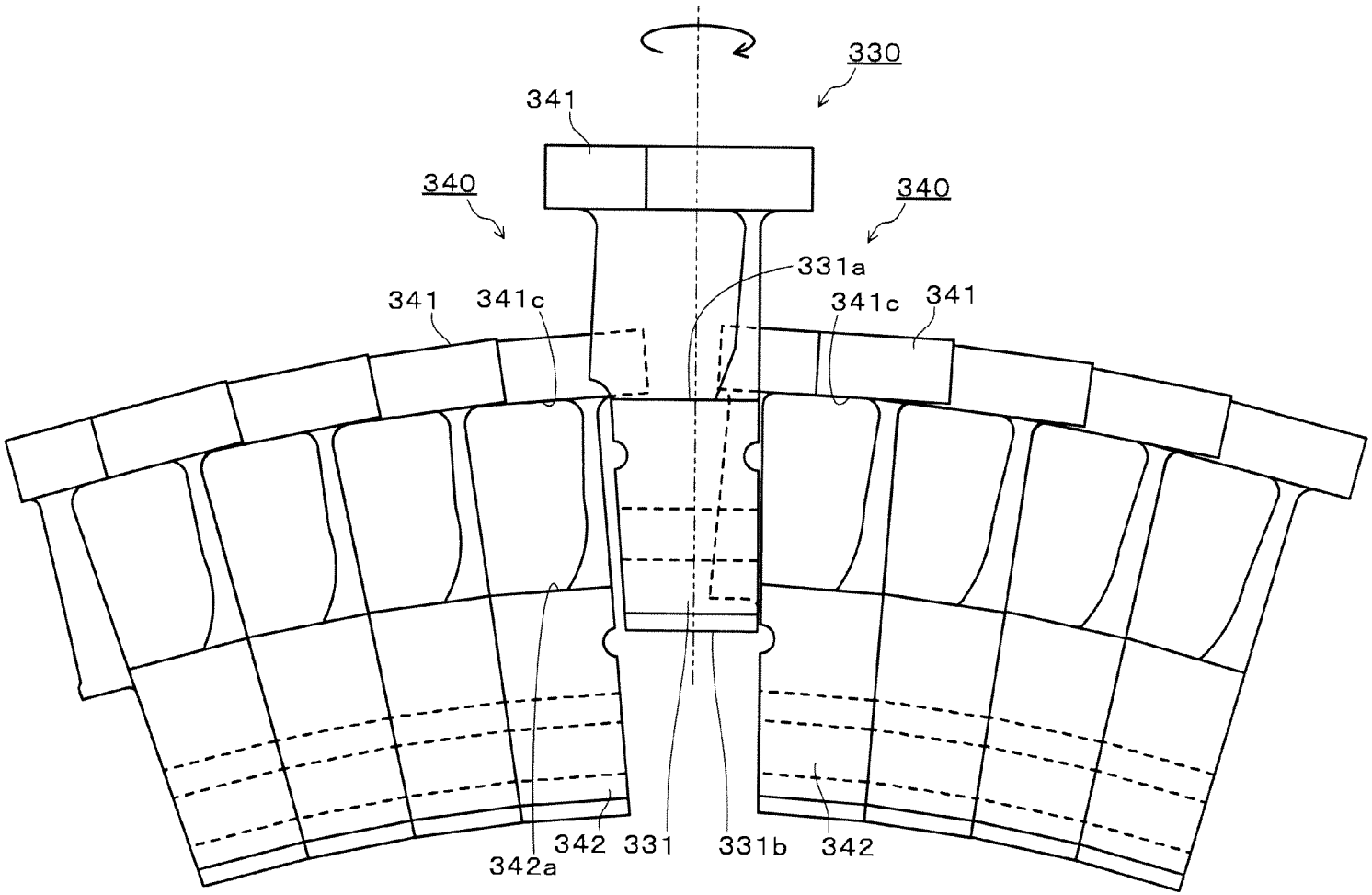
FIG. 24 is a plan view of a state of inserting a notch blade between the turbine rotor blades having a snubber cover structure viewed from the axial direction of the turbine rotor.
Figure 25:
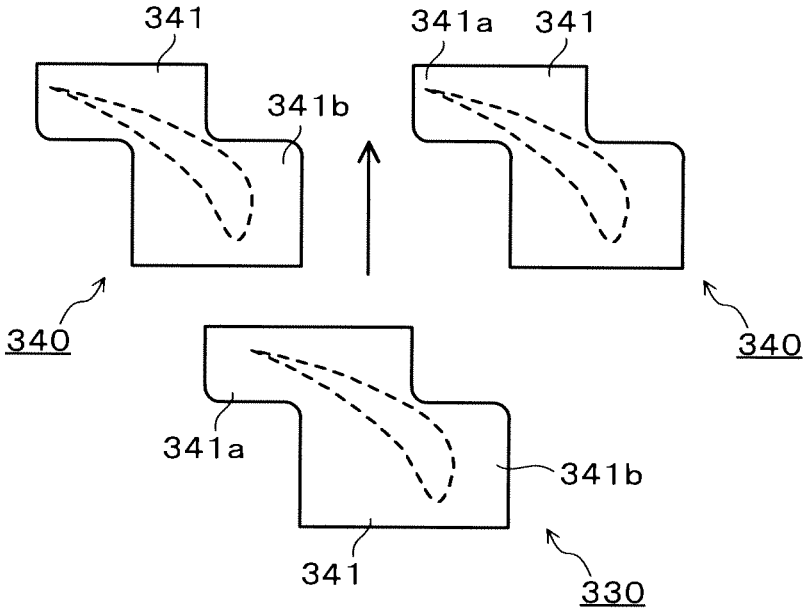
FIG. 25 is a plan view of a state of inserting the notch blade between the turbine rotor blades having a snubber cover structure viewed from the snubber cover side.

FIG. 23, FIG. 24 and FIG. 25 show the way of inserting the notch blade from an axial direction with respect to the rotational axis in the above-described circumstances. FIG. 23 is a plan view of a state of inserting a notch blade 330 for the turbine rotor blade having the snubber cover structure viewed from the circumferential direction (namely, a sectional view including an rotational axis of the turbine rotor (meridional section view)). FIG. 24 is a plan view of a state of inserting the notch blade 330 for the turbine rotor blade having the snubber cover structure viewed from the axial direction. FIG. 25 is a plan view of a state of inserting the notch blade 330 for the turbine rotor blade having the snubber cover structure viewed from the snubber cover 341 side (radially outside the turbine rotor axis).

As shown in FIG. 23 and FIG. 24, when a top end 331*a* of a bucket dovetail 331 of the notch blade 330 is located inside an under surface 341*c* of the snubber cover 341 of a adjacent notch blade 340 in the radial direction and a lower end 331*b* of the bucket dovetail 331 of the notch blade 330 is located outside the outermost circumferential surface of the turbine rotor, the notch blade 330 is inserted in the axial direction into the space between the previously implanted adjacent notch blades 340. When the notch blade 330 reaches a final position in the axial direction, the notch blade 330 is vertically inserted in the radial direction.

According to this method of inserting the notch blade 330, the initial position of the top end 331*a* of the bucket dovetail 331 of the notch blade 330 is located inside in the radial direction the under surface 341*c* of the snubber cover 341 of the adjacent notch blade 340. Therefore, a problem that the notch blade 330 and the adjacent notch blade 340 interfere with each other and the notch blade 330 cannot be implanted can be avoided.

However, when the turbine rotor blade has a circumferential width of the snubber cover 341 and a circumferential width of an effective blade portion which are relatively large with respect to the circumferential pitch and is inserted in the axial direction, there may be a situation that the trailing edge of the notch blade 330 interferes with a suction-side overhanging portion 341*b* of the snubber cover 341 of the adjacent notch blade 340 on the pressure side of the rotor blade-notch blade 330 or the leading edge of the notch blade 330 interferes with a pressure-side overhanging portion 341*a* of the snubber cover 341 of the adjacent notch blade 340 on the suction side of the rotor blade-notch blade 330.

In FIG. 23 through FIG. 25, a length in a radial direction of an effective blade portion of the adjacent notch blades 340 are shorter than a length in the radial direction of the bucket dovetail 331 of the notch blade 330. With this type of the turbine rotor blade, when the top end 331*a* of the bucket dovetail 331 of the notch blade 330 is positioned on the side of the turbine rotor the under surface 341*c* of the snubber cover 341 of the adjacent notch blade 340, the lower end 331*b* of the bucket dovetail 331 of the notch blade 330 is to be located inside in the radial direction a top end 342*a* of a bucket dovetail 342 of the adjacent notch blade 340. Thus, in a case where the notch blade 330 is inserted in the axial direction, the movement of the lower end 331*b* of the bucket dovetail 331 of the notch blade 330 cannot be secured, and the effective blade portion of the notch blade 330 interferes with the snubber cover 341 of the adjacent notch blade 340.

Embodiments described below have been made to improve the assimilability of a turbine rotor blade assembly and a steam turbine notch blade while ensuring the structural reliability of the turbine rotor blades.

According to an aspect of the present invention, there is provided a turbine rotor blade assembly comprising a turbine rotor and a plurality of turbine rotor blades implanted on the turbine rotor in a circumferential direction, wherein the turbine rotor blade comprising an effective blade portion, a tangential type bucket dovetail disposed at the root portion of the effective blade portion and a cover portion integrally formed on a tip of the effective blade portion. The cover portion comprises a pressure-side overhanging portion protruded in a circumferential direction with respect to the rotational axis at a trailing edge side of the turbine rotor blade and a suction-side overhanging portion protruded in the circumferential direction at a leading edge side of the turbine rotor blade, so that the cover portion mutually contacts adjacent cover portion. A length in the radial direction of the bucket dovetail of a notch blade, which is inserted last among the turbine rotor blades, is shorter than a length in the radial direction of the effective blade portion and a length in the radial direction of the bucket dovetail of adjacent notch blades, which are implanted adjacent to the notch blade.

And, the steam turbine according to an embodiment is provided with the above-described turbine rotor blade assembly.

Embodiments are described below with reference to the drawings.

(First Embodiment)

Figure 1:
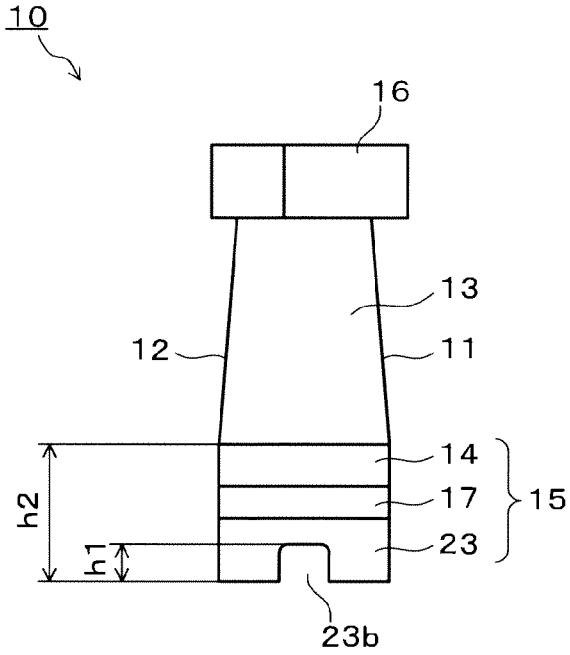
FIG. 1 is a plan view of a notch blade applied to the turbine rotor blade assembly of a first embodiment viewed from a circumferential direction of a turbine rotor.
Figure 2:
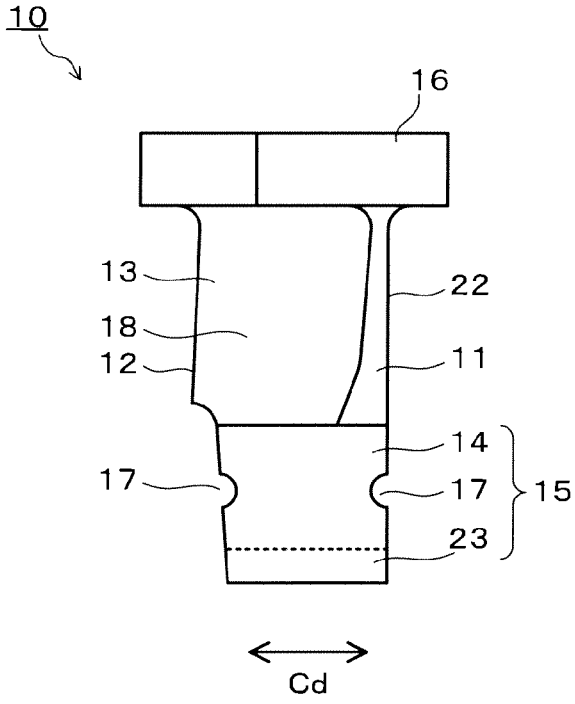
FIG. 2 is a plan view of the notch blade applied to the turbine rotor blade assembly of the first embodiment viewed from an axial direction of the turbine rotor.
Figure 3:
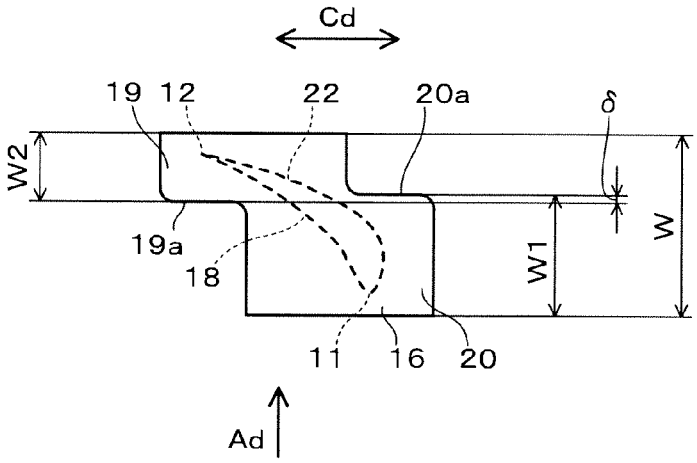
FIG. 3 is a plan view of a notch blade applied to the turbine rotor blade assembly of the first embodiment viewed from the cover side.
Figure 4:
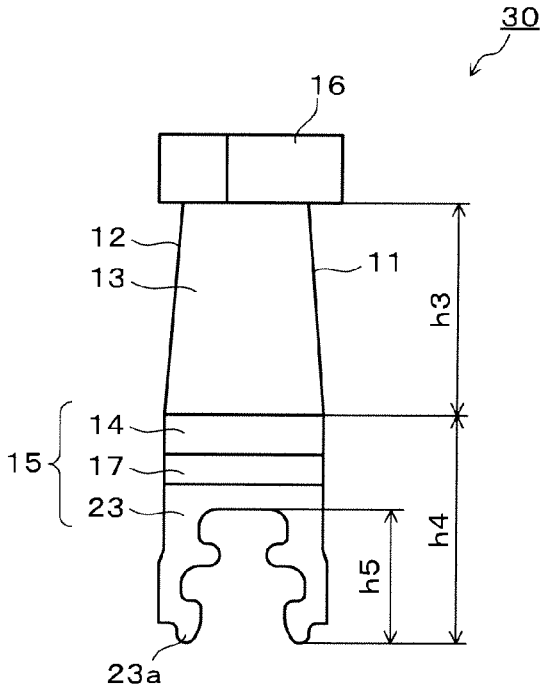
FIG. 4 is a plan view of a adjacent notch blade applied to the turbine rotor blade assembly of the first embodiment viewed from the circumferential direction of the turbine rotor.

FIG. 1 is a plan view of a notch blade 10 applied to a turbine rotor blade assembly of a first embodiment viewed from the circumferential direction of a turbine rotor. FIG. 2 is a plan view of the notch blade 10 applied to the turbine rotor blade assembly of the first embodiment viewed from the axial direction (upstream side). FIG. 3 is a plan view of the notch blade 10 applied to the turbine rotor blade assembly of the first embodiment viewed from a cover portion 16 side (radially outside of the turbine rotor axis). FIG. 4 is a plan view of an adjacent notch blade 30 applied to the turbine rotor blade assembly of the first embodiment viewed from the circumferential direction.

The turbine rotor blade assembly of the first embodiment is configured by implanting and arranging the turbine rotor blades onto the turbine rotor of the steam turbine in a circumferential direction with respect to an axis of the turbine rotor to form an annular blade cascade. The turbine rotor blades comprise the notch blade 10, which is the turbine rotor blade implanted last among the turbine rotor blade configuring the turbine rotor blade assembly, and other turbine rotor blades (i.e. normal blades). Here, both of the normal blades, which are the turbine rotor blades other than the notch blade 10, located adjacent to the notch blade 10 in the circumferential direction are defined as the adjacent notch blades 30.

As shown in FIG. 1 and FIG. 2, the notch blade 10 comprises an effective blade portion 13, a bucket dovetail 15 of a tangential type (circumferential implant type) and a cover portion 16. Blade effective portion 13 comprises a leading edge 11 as a entrance portion of working fluid and a trailing edge 12 as a exit portion of the working fluid. Cover portion 16 is integrally formed on a tip (i.e. outermost portion of blade effective portion 13) of the effective blade portion 13. Bucket dovetail 15 comprises a solid portion (blade base) 14 disposed at a root portion of the effective blade portion 13, key grooves 17 and a saddle-shaped leg portion 23. Bucket dovetail 15 has an outside type implanting shape. Key grooves 17 are provided at both of circumferential ends of solid portion 14 of the bucket dovetail 15. Key groove 17 has a semicircular cross section for inserting a stop key in the axial direction for fixing the notch blade 10 to the adjacent notch blade 30. The tangential type blade implanting denotes that the bucket dovetail 15 is mounted to fit with a rotor dovetail, which is a fitting portion of the bucket dovetail 15 disposed along the circumferential direction of the turbine rotor. Each of the turbine rotor blades are implanted from an inserting portion of the rotor dovetail and slid in the circumferential direction to its predetermined position. The outside type implanting shape denotes that the rotor dovetail is protruded to an outer peripheral side of the rotor (rotor wheel) and bucket dovetail 15 is implanted on the rotor dovetail so to encompass the outer peripheral edge of the rotor dovetail of the rotor wheel from an outside.

Similar to the notch blade 10, the adjacent notch blade 30 comprises the effective blade portion 13, the tangential type bucket dovetail 15 having the solid portion 14, and the cover portion 16 as shown in FIG. 4. And, the bucket dovetail 15 has an outside type implanting shape. The key groove 17 is formed on one side surface (i.e. a side of notch blade 10) of the solid portion 14 of the bucket dovetail 15 at a position corresponding to the key groove 17 of the notch blade 10. Thus, circular key holes are formed once the notch blade 10 and the adjacent notch blades 30 are implanted. After the notch blade 10 is inserted, the stop key is axially inserted into the key hole for fixation. Thus, the notch blade 10 is fixed. Accordingly, the notch blade 10 is prevented from separating during the operation of the steam turbine.

The turbine rotor blades other than the notch blade 10 and the adjacent notch blades 30 (in other words, the normal blades other than adjacent notch blades 30) of the turbine rotor blade assembly have a shape that the key groove 17 is eliminated from the adjacent notch blade 30 shown in FIG. 4.

In the above-described notch blade 10 and adjacent notch blades 30, the effective blade portion 13, the bucket dovetail 15 and the cover portion 16 are integrally formed by cutting out from a single material or by separately producing individual component parts and combining them into one integral shape.

The cover portion 16 has the same shape for all of the turbine rotor blades, i.e. the notch blade 10, the adjacent notch blades 30 and other turbine rotor blades. Cover portion 16 comprises a pressure-side overhanging portion 19, which is protruded in the circumferential direction Cd (i.e. an arrangement direction) and a suction-side overhanging portion 20 which is protruded in the circumferential direction Cd. Pressure-side overhanging portion 19 is provided at the trailing edge 12 side of the effective blade portion 13, protruded from the side edge of cover portion 16 located on a pressure side 18 of the effective blade portion 13 as shown in FIG. 3. Suction-side overhanging portion 20 is provided at the leading edge 11 side of the effective blade portion 13, protruded from the side edge of cover portion 16 located on a suction side 22 of the effective blade portion 13. Thus, the cover portion 16 has a so-called snubber cover structure.

Figure 5:
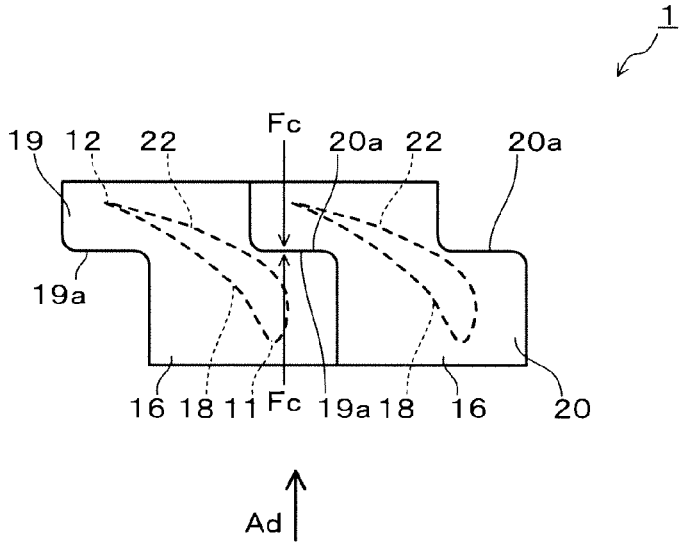
FIG. 5 is a plan view of the turbine rotor blade assembly viewed from the cover side.

FIG. 5 is a plan view of the turbine rotor blade assembly 1 viewed from the cover portion 16 side (namely, radially outside with respect to the turbine rotor axis). As shown in FIG. 5, in the turbine rotor blade assembly 1 provided with the turbine rotor blades having the cover portion 16 configured as described above, a side surface 19*a* of a pressure-side overhanging portion 19 contacts with a side surface 20*a* of the suction-side overhanging portion 20. For example, the side surface 19*a* of the pressure-side overhanging portion 19 and the side surface 20*a* of the suction-side overhanging portion 20 may be configured to be a surface substantially orthogonal to a axial direction Ad. Thus, the annular blade cascade is assembled while partly contacting the cover portion 16 of the adjacent turbine rotor blades to configure the grouped blades structure.

As shown in FIG. 3, it is configured that a width w of the cover portion 16 in the axial direction Ad is smaller than a length (w1+w2) a total of a width W1 of the suction-side overhanging portion 20 in the axial direction Ad and a width W2 of the pressure-side overhanging portion 19 in the axial direction Ad. A value (W1+W2−W) resulting from the subtraction of the width W of the cover portion 16 from the total length (W1+W2) of the width w1 of the suction-side overhanging portion 20 and the width w2 of the pressure-side overhanging portion 19 is a cover interference degree δ generated when the side surface 19*a* of the pressure-side overhanging portion 19 and the side surface 20*a* of the suction-side overhanging portion 20 are contacted mutually. The cover portion 16 is configured to be forcefully twisted by the cover interference degree δ. It can also be configured that the side surface 19*a* and the side surface 20*a* have an angle to a surface orthogonal to the axial direction Ad. In this case, a line of intersection between the side surface 19*a* or the side surface 20*a* and the surface orthogonal to the axial direction Ad may preferably be set to the normal of the turbine rotor axis (i.e. the radial direction).

When the cover portion 16 is twisted, cover contact reaction force Fc is generated in the side surface 19*a* of the pressure-side overhanging portion 19 and the side surface 20*a* of the suction-side overhanging portion 20 along the normal direction of the contact surface to which side surfaces 19*a* and 20*a* are contacted (Note that the normal direction of the contact surface corresponds to a axial direction Ad when the side surface 19*a* of the pressure-side overhanging portion 19 and the side surface 20*a* of the suction-side overhanging portion 20 are configured of a surface orthogonal to the axial direction Ad).

This cover contact reaction force Fc becomes an element of frictional force to suppress vibration generated in the turbine rotor blades during the operation of the steam turbine.

The structure of the bucket dovetail 15 is described below.

As shown in FIG. 1 and FIG. 4, the bucket dovetail 15 is configured of the solid portion 14 and the saddle-shaped leg portion 23 having an outside type implanting shape and inwardly branched into two at a bifurcated portion in the radial direction.

Figure 6:
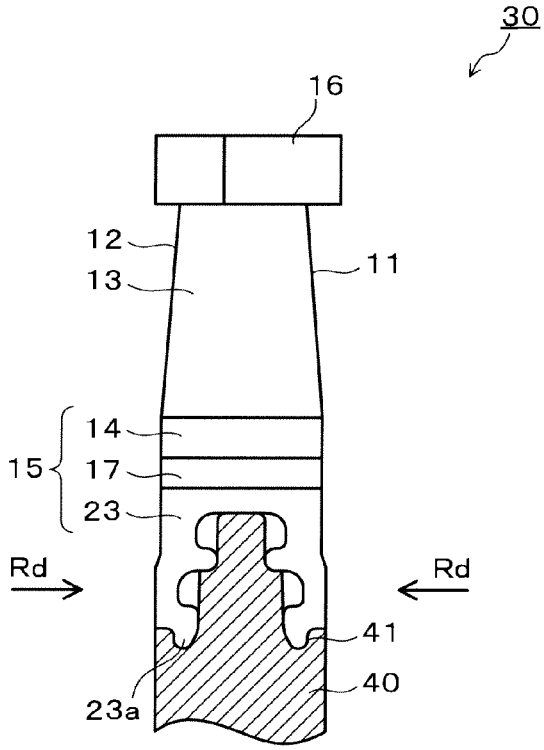
FIG. 6 is a plan view of the adjacent notch blade which is implanted on the turbine rotor viewed from the circumferential direction of the turbine rotor.

First, the structure of the bucket dovetail 15 of the turbine rotor blades other than the notch blade 10 (i.e. normal blades) is described below. Here, the adjacent notch blade 30 is described as an example of the normal blades. FIG. 6 is a plan view of the adjacent notch blade 30 implanted on the rotor dovetail of the turbine rotor (turbine wheel 40) viewed from the circumferential direction. The turbine rotor blades having a tangential type (circumferential implanting type) bucket dovetail are implanted to the rotor dovetail by inserting radially inward at the inserting portion, which is provided at one portion of the rotor dovetail along the circumferential direction. Sequentially, radially inserted turbine rotor blade is slid in the circumferential direction to the predetermined position so that the bucket dovetail 15 fits to the rotor dovetail. The turbine wheel 40 of FIG. 6 is shown as a cross section (meridional cross section) including the turbine rotor axis at the circumferential position of the inserting portion.

As shown in FIG. 4 and FIG. 6, a protruded portion 23*a* is formed in the circumferential direction (arrangement direction) of the adjacent notch blade 30 at the root ends (radial inward ends) of both saddle-shaped leg portions 23 which is inwardly branched into two in the radial direction. Meanwhile, as shown in FIG. 6, a groove 41 which functions as a groove for fitting the protruded portion 23*a* of the adjacent notch blade 30 is formed along the circumferential direction Cd in the rotor dovetail of the turbine wheel 40 (the turbine rotor) on which the adjacent notch blade 30 is implanted.

According to configurations of the bucket dovetail 15 and the turbine wheel 40 as described above, the groove 41 of rotor dovetail of the turbine wheel 40 (turbine rotor) functions as a twist-return restraint piece, so that a twist-return restraint reaction force Rd can be generated between the protruded portions 23*a* at the root ends (radial inner ends) of the saddle-shaped leg portion 23 and the grooves 41. The reaction force Rd, as described above, can adequately assure cover contact reaction force Fc generated in the contact surface between the side surface 19*a* of the pressure-side overhanging portion 19 and the side surface 20*a* of the suction-side overhanging portion 20, so that a vibration control of the turbine rotor blade assembly 1 can be improved.

Figure 7:
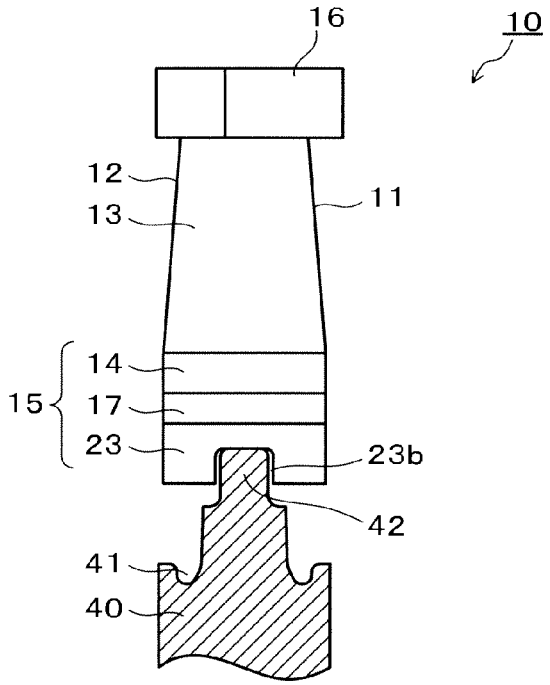
FIG. 7 is a plan view of a notch blade which is implanted on the turbine wheel of the turbine rotor viewed from the circumferential direction of the turbine rotor.

Next, the structure of the bucket dovetail 15 of the notch blade 10 is described below. FIG. 7 is a plan view of the notch blade 10 implanted on the turbine wheel 40 of the turbine rotor viewed from the circumferential direction.

As shown in FIG. 7, saddle-shaped portion 23 of the notch blade 10 comprises an insertion groove 23*b*, which is formed at the bifurcated portion. The notch blade 10 is assembled by inserting insertion groove 23*b* of saddle-shaped portion 23 of bucket dovetail 15 at the inserting portion to an outer peripheral end portion 42. Outer peripheral end portion 42 is provided at the inserting portion of the rotor dovetail of the turbine wheel 40 (turbine rotor) to fit to insertion groove 23*b* of the saddle-shaped leg portion 23. After insertion of notch blade 10 to outer peripheral portion 42, notch blade 10 is fixed with the adjacent notch blades 30 by the stop key as described above. Since the insertion groove 23*b* of the saddle-shaped leg portion is fit to the outer peripheral end portion 42 of the turbine wheel 40, the outer peripheral end portion 42 of the turbine wheel 40 functions as a twist-return restraint piece and generates the twist-return restraint piece similar to reaction force Rd described above.

A gap in the axial direction between the insertion groove 23*b* of the saddle-shaped leg portion 23 and the outer peripheral end portion 42 of the turbine wheel 40 can be set as preferably. For example the gap may be set to be smaller than the normal blades. The smaller the gap is set, the more secure the twist-return restraint piece reaction force Rd can be generated so that the cover contact reaction force Fc can be maintained high enough. Therefore, the twist return of the cover portion 16 is prevented surely during the operation of the steam turbine, and a reliability of the circumferentially grouped blades structure can be improved.

As shown in FIG. 7 in this embodiment, the side surface of the rotor dovetail of the turbine wheel 40 between a lower end of the bucket dovetail 15 of the notch blade 10 and the groove 41 of the rotor dovetail of turbine wheel 40 is in an exposed. However, a spacer member for covering the exposed side surface of the rotor dovetail of turbine wheel 40 may be disposed.

Figure 8:
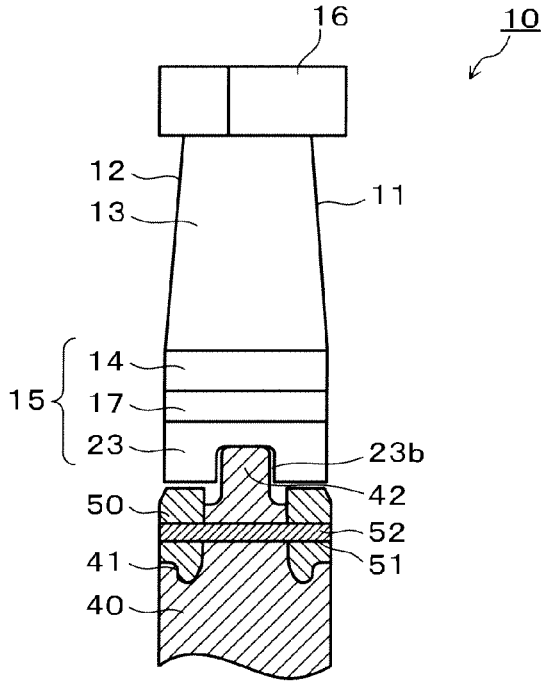
FIG. 8 is a plan view of the notch blade, which is implanted on the turbine wheel of the turbine rotor and provided with a spacer member, viewed from the circumferential direction of the turbine rotor.

FIG. 8 is a plan view of the notch blade 10 implanted on the turbine wheel 40 of the turbine rotor when it is provided with a spacer member 50 viewed from the circumferential direction. As shown in FIG. 8, the plate-like spacer member 50 is provided along the exposed both side surfaces of the inserting portion of the rotor dovetail of the turbine wheel 40. The spacer member 50 is formed with a through hole 51 which leads from one side of the spacer member 50 to the other side of the spacer member 50 through the turbine wheel 40 as shown in FIG. 8. The spacer member 50 is fixed by fitting the stop key 52 into the through hole 51. The method of fixing the spacer member 50 is not particularly limited and not restricted to the above-described method.

Thus, the spacer member 50 can prevent the rotor dovetail of the turbine wheel 40 from being exposed to steam during the operation of the steam turbine. Spacer member 50 can take the weight balance in the circumferential direction of the turbine rotor blade assembly 1, so that looseness can be suppressed.

The radial lengths of effective blade portion 13 and the bucket dovetail 15 are described below.

A length h2 in the radial direction of the bucket dovetail 15 of the notch blades 10 (see FIG. 1) is configured to be shorter than a length h3 in the radial direction of the effective blade portion 13 of the adjacent notch blade 30 (see FIG. 4) and a length h4 in the radial direction of the bucket dovetail 15 (see FIG. 4).

As described above, the turbine rotor blades of the turbine rotor blade assembly 1 according to the embodiment, the length h2 in the radial direction of the bucket dovetail 15 of the notch blade 10 is set to be shorter than the length h3 in the radial direction of the effective blade portion 13 of the adjacent notch blade 30. With this shortened bucket dovetail 15 of notch blade 10, a length h1 in the radial direction of the saddle-shaped leg portion 23 of the bucket dovetail 15 of the notch blade 10 is set to be shorter than a length h5 in the radial direction of the saddle-shaped leg portion 23 of the adjacent notch blade 30 (or normal blades), so that the length h2 in the radial direction of the bucket dovetail 15 of the notch blade 10 is configured to be shorter than the length h4 in the radial direction of the bucket dovetail 15 of the adjacent notch blade 30 (or normal blades).

Figure 9:
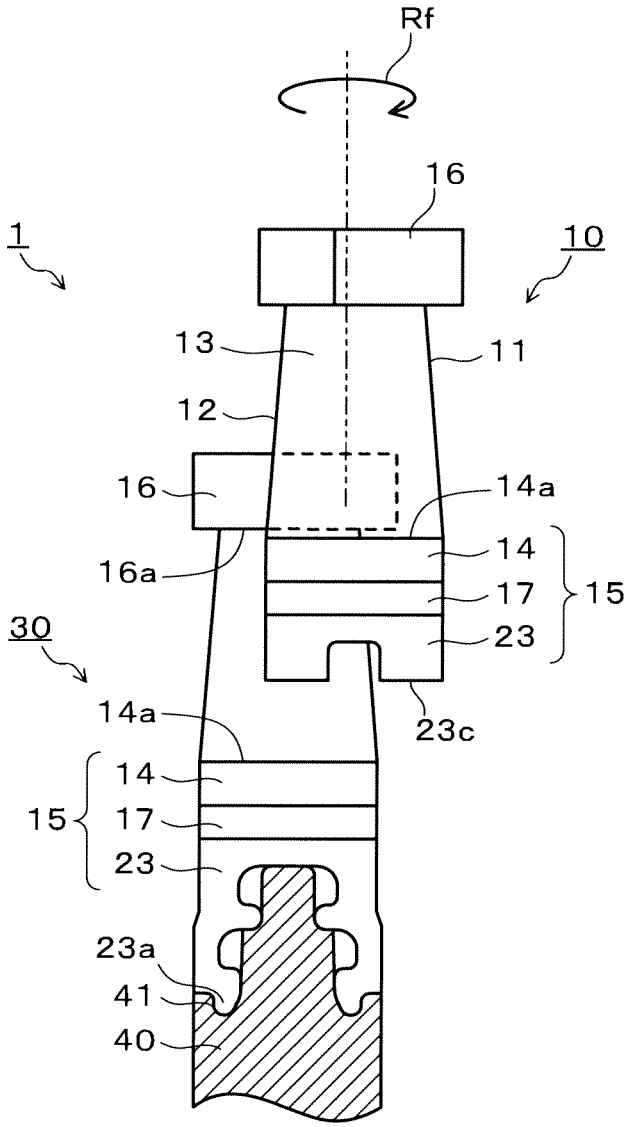
FIG. 9 is a plan view of a state of inserting the notch blade in a process of assembling the turbine rotor blade assembly of the first embodiment viewed from the circumferential direction of the turbine rotor.
Figure 10:
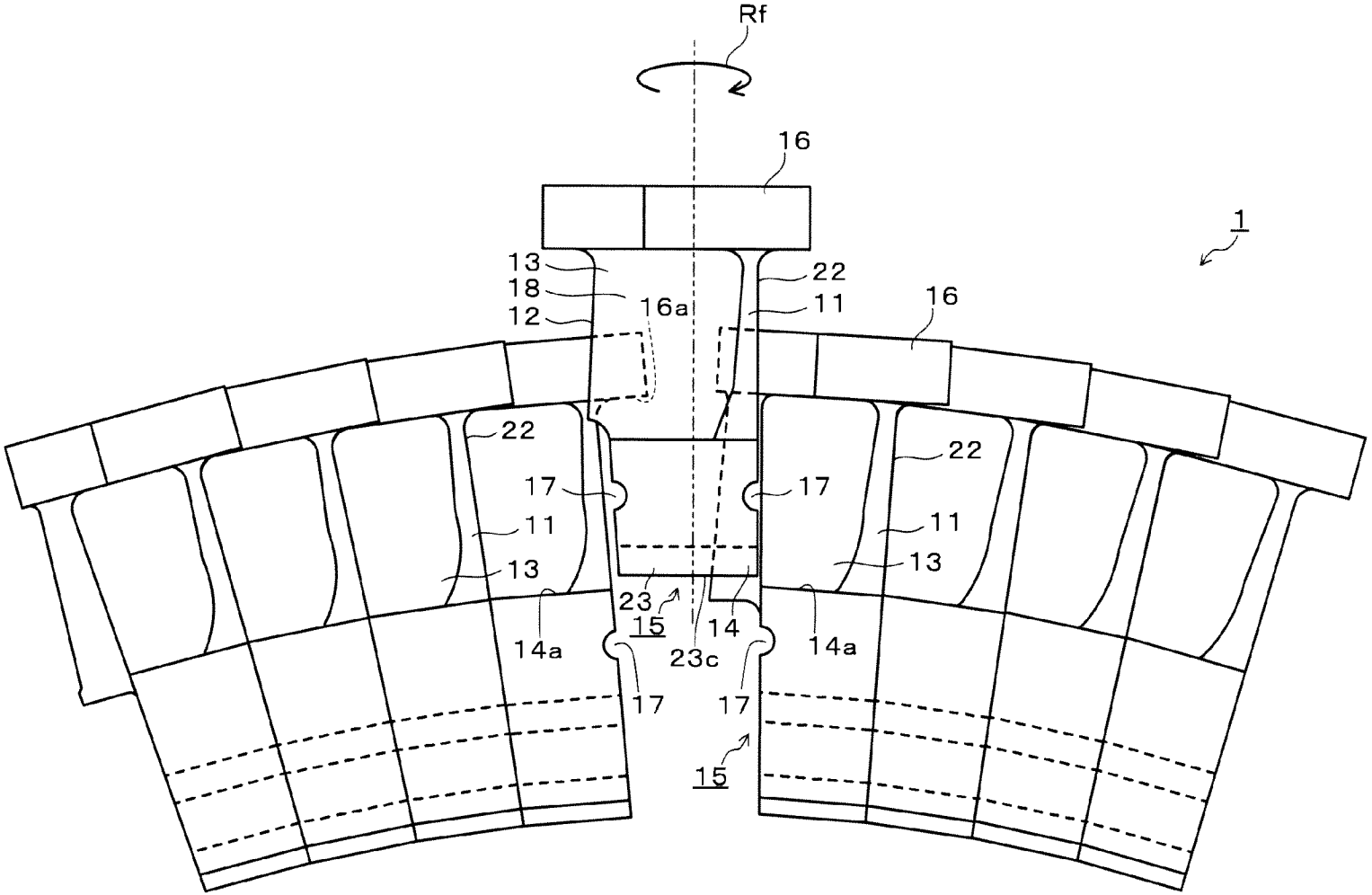
FIG. 10 is a plan view of a state of inserting a notch blade in a process of assembling the turbine rotor blade assembly of the first embodiment viewed from an upstream side of working fluid in the axial direction of the turbine rotor.

FIG. 9 is a plan view of a state of inserting the notch blade 10 in a process of assembling the turbine rotor blade assembly 1 of the first embodiment viewed in the circumferential direction. Similar to FIG. 6, FIG. 9 shows the turbine wheel 40 as a cross section (meridional cross section) including a turbine rotor axis at a circumferential position of the inserting portion. FIG. 10 is a plan view of a state of inserting the notch blade 10 in a process of assembling the turbine rotor blade assembly 1 of the first embodiment viewed from an upstream side of working fluid in the axial direction.

As shown in FIG. 9 and FIG. 10, when a radial position of a top end 14a of the bucket dovetail 15 (solid portion 14) of the notch blade 10 is located inside with respect to an inner surface 16*a* of the cover portion 16 of the adjacent notch blade 30, the notch blade 10 is inserted in the axial direction into the space between the already implanted adjacent notch blades 30. And, when the notch blade 10 has reached a final position (a proper and predetermined position) in the axial direction, the notch blade 10 is inserted vertically (i.e. radially) in the radial direction. Thus, the turbine rotor blade assembly 1 is relatively easily assembled by inserting the notch blade 10 and inserting the stop key into the key hole, which is formed by the key grooves 17 of the notch blade 10 and the adjacent notch blades 30, for fixation.

Here, when the radial position of the top end 14*a* of the bucket dovetail 15 (solid portion 14) of the notch blade 10 is located inside with respect to the inner surface 16*a* of the cover portion 16 of the adjacent notch blade 30, the radial direction of a lower end 23*c* of the bucket dovetail 15 of the notch blade 10 is located outside with respect to the top end 14*a* of the bucket dovetail 15 (solid portion 14) of the adjacent notch blade 30 because the length h2 of the bucket dovetail 15 of the notch blade 10 is configured to be shorter than the length h3 of the effective blade portion 13 of the adjacent notch blade 30. Thus, the bucket dovetail 15 of the notch blade 10 does not interfere with the bucket dovetail 15 of the adjacent notch blade 30 at the time of inserting the notch blade 10 in the axial direction, so that a rotational movement Rf around the radial direction and a circumferential movement of the notch blade 10 can be secured during assembling of notch blade 10.

Therefore, when the notch blade 10 is inserted in the axial direction, the interference between a trailing edge 12 of the notch blade 10 and the cover portion 16 of the adjacent notch blade 30 located on the pressure side 18 of the notch blade 10 can be prevented. The interference between the leading edge 11 of the notch blade 10 and the cover portion 16 of the adjacent notch blade 30 located on the suction side 22 of the notch blade 10 can also be prevented.

In the adjacent notch blade 30, the length h3 of the effective blade portion 13 may be shorter than the length h4 of the bucket dovetail 15. The blade cascade which has the length h3 of the effective blade portion 13 configured to be shorter than the length h4 of the bucket dovetail 15, for example, is applied to a turbine blade cascade arranged at an upstream side of working fluid, such as a first-stage rotor blades assembly or the like, of the steam turbine. For these rotor blade assemblies, into which the notch blade is sometimes difficult to be inserted, the structure of the turbine rotor blade assembly of the first embodiment can be applied and improve its assemblability.

As described above, the turbine rotor blade assembly 1 and steam turbine of the first embodiment can have the length h2 in the radial direction of the bucket dovetail 15 of the notch blade 10 configured to be shorter than the length h3 in the radial direction of the effective blade portion 13 of the adjacent notch blade 30 and the length h4 in the radial direction of the bucket dovetail 15. Thus, when the notch blade 10 is inserted in the axial direction, a rotational movement Rf around radial direction and a circumferential movement of the notch blade 10 can be secured during assembling of notch blade 10.

Therefore, when the notch blade 10 is inserted in the axial direction, the interference between the trailing edge 12 of the notch blade 10 and the cover portion 16 of the adjacent notch blade 30 located on the pressure side 18 of the notch blade 10 can be prevented. The interference between the leading edge 11 of the notch blade 10 and the cover portion 16 of the adjacent notch blade 30 located on the suction side 22 of the notch blade 10 can also be prevented. Thus, according to the turbine rotor blade assembly 1 and steam turbine according to the first embodiment, the assemblability of the notch blade 10 can be improved while ensuring the structural reliability of the turbine rotor blades of the steam turbine.

(Second Embodiment)

Turbine rotor blades applied to the turbine rotor blade assembly 1 of the second embodiment is similar to the turbine rotor blades of the first embodiment except that the bucket dovetail 15 has a different structure. The differences are mainly described below.

Figure 11:
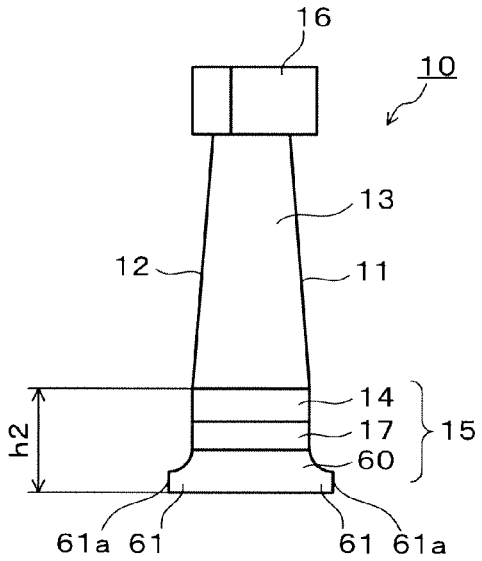
FIG. 11 is a plan view of a notch blade applied to the turbine rotor blade assembly of a second embodiment viewed from a circumferential direction of a turbine rotor.
Figure 12:
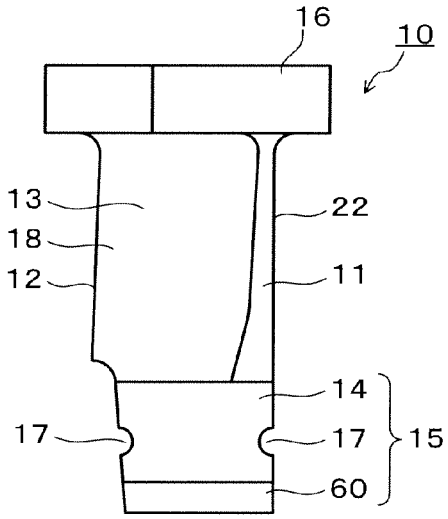
FIG. 12 is a plan view of a notch blade applied to the turbine rotor blade assembly of the second embodiment viewed from the axial direction of the turbine rotor.
Figure 13:
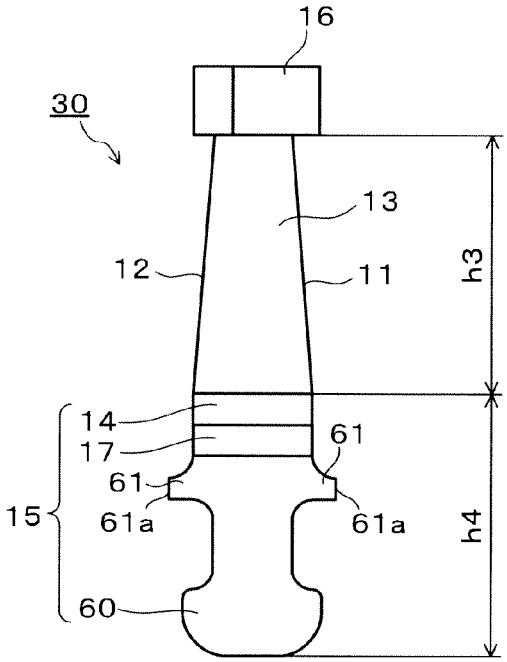
FIG. 13 is a plan view of a adjacent notch blade applied to the turbine rotor blade assembly of the second embodiment viewed from the circumferential direction of the turbine rotor.

FIG. 11 is a plan view of the notch blade 10 applied to the turbine rotor blade assembly of the second embodiment viewed from the circumferential direction. FIG. 12 is a plan view of the notch blade 10 applied to the turbine rotor blade assembly of the second embodiment viewed from the axial direction (upstream). FIG. 13 is a plan view of the adjacent notch blade 30 applied to the turbine rotor blade assembly of the second embodiment viewed from the circumferential direction. Elements or parts corresponding to those of the first embodiment are denoted with the same reference numerals, and overlapped descriptions will be omitted or simplified.

The turbine rotor blade assembly of the second embodiment is configured by implanting the turbine rotor blades having an inside type blade dovetail into the turbine rotor of the steam turbine to provide an annular blade cascade.

As shown in FIG. 11 and FIG. 12, the notch blade 10 comprises an effective blade portion 13 which has a leading edge 11 as the entrance portion of the working fluid and a trailing edge 12 as a exit portion of the working fluid, a bucket dovetail 15 of a tangential type (circumferential implant type), and a cover portion 16. Bucket dovetail 15 comprises a solid portion (blade base) 14 disposed at a root portion of the effective blade portion 13, key grooves 17 and an implanting insertion portion 60. Cover portion 16 is integrally formed on the tip of the effective blade portion 13. The bucket dovetail 15 has an inside type implanting shape. The inside type implanting shape denotes one that the rotor dovetail is formed as an inner groove along the outer circumferential surface of the turbine rotor and bucket dovetail 15 is implanted in the turbine rotor by fitting with the inner groove formed along the outer circumferential surface of the turbine rotor. Key grooves 17 are provided at both of circumferential ends of solid portion 14 of the bucket dovetail 15. Key groove 17 has a semicircular cross section for inserting a stop key in the axial direction for fixing the notch blade 10 to the adjacent notch blade 30. Each of the turbine rotor blades are implanted from an inserting portion of the rotor dovetail and slid in the circumferential direction to its predetermined position.

Similar to the notch blade 10, the adjacent notch blade 30 comprises the effective blade portion 13, the tangential type bucket dovetail 15 having the solid portion 14, and the cover portion 16 as shown in FIG. 13. And, the bucket dovetail 15 has an inside type implanting shape. The key groove 17 is formed on one side surface (i.e. a side of notch blade 10) of the solid portion 14 of the bucket dovetail 15 at a position corresponding to the key groove 17 of the notch blade 10. Thus, circular key holes are formed once the notch blade 10 and the adjacent notch blades 30 are implanted. After the notch blade 10 is inserted, the stop key is axially inserted into the key hole for fixation. Thus, the notch blade 10 is fixed. Accordingly, the notch blade 10 is prevented from separating during the operation of the steam turbine.

In the above-described notch blade 10 and adjacent notch blades 30, the effective blade portion 13, the bucket dovetail 15 and the cover portion 16 are integrally formed by cutting out from a single material or by separately producing individual component parts and combining them into one integral shape.

The cover portion 16 of the notch blade 10 and the adjacent notch blade 30 are configured similar to the turbine rotor blades applied to the turbine rotor blade assembly 1 of the first embodiment.

Similar to the first embodiment, the turbine rotor blades other than the notch blade 10 and adjacent notch blades 30 (in other words, the normal blades other than adjacent notch blades 30) of the turbine rotor blade assembly according to this embodiment also have a shape that the key groove 17 is omitted from the adjacent notch blades 30 shown in FIG. 13.

The structure of the bucket dovetail 15 is described below.

As shown in FIG. 11 and FIG. 13, the bucket dovetail 15 is configured of the solid portion 14 and the implanting insertion portion 60 having an inside type implanting shape. For example, the implanting insertion portion 60 comprises a T shape as shown in FIG. 11 and FIG. 13.

The bucket dovetail 15 of the notch blade 10 and the adjacent notch blade 30 is formed with a protruded portions 61 which function as a twist-preventing piece protruded toward the leading edge 11 and the trailing edge 12 of the turbine rotor blade in the axial direction. In addition, both of the protruded portions 61 on the leading edge 11 side and trailing edge 12 side are formed along the circumferential direction. And, the root end (i.e. inner side end) of the protruded portions 61 is formed as a flat surface 61*a*.

Figure 14:
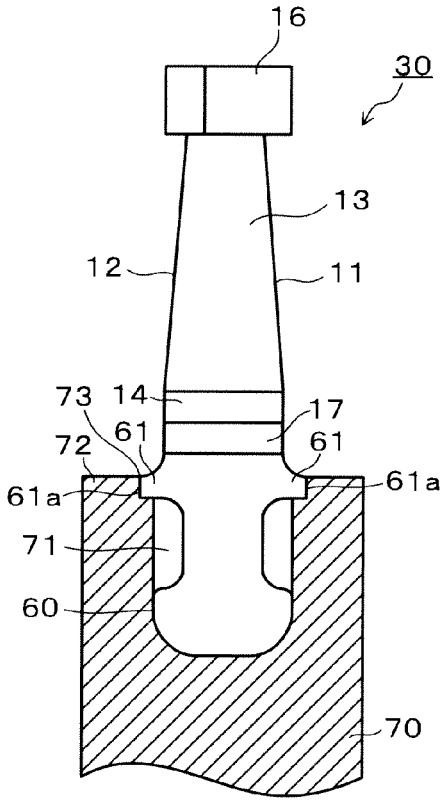
FIG. 14 is a plan view of the adjacent notch blade, which is implanted in the turbine wheel of the turbine rotor, viewed from the circumferential direction of the turbine rotor.

FIG. 14 is a plan view of the adjacent notch blade 30 implanted in a turbine wheel 70 of the turbine rotor viewed from the circumferential direction. The turbine wheel 70 of FIG. 14 is shown as a cross section (meridional cross section) including a turbine rotor axis at a circumferential position of the inserting portion. A rotor dovetail 71 of the turbine wheel 70 is formed in the circumferential direction with a cutout groove 73 provided with a hook portion 72 which is contacted to the flat surface 61*a* of the protruded portion 61 of the turbine rotor blade.

The protruded portion 61 of the turbine rotor blade is fitted with the cutout groove 73 as shown in FIG. 14 for example. The hook portion 72 of the rotor dovetail 71 functions as a twist-return restraint piece, so that a twist-return restraint reaction force can be generated between the protruded portion 61 of the turbine rotor blade and the hook portion 72. The generation of the twist-return restraint reaction force can adequately assure a cover contact reaction force generated Fc in the contact surface between the side surface 19*a* of the pressure-side overhanging portion 19 and the side surface 20*a* of the suction-side overhanging portion 20. Therefore, a vibration control of the turbine rotor blade assembly 1 can be improved. So, during the operation of the steam turbine, the twist return of the cover portion 16 can be prevented surely, and a reliability of the circumferentially grouped blades structure can be improved.

As shown in FIG. 11, protruded portions 61, which fit with cutout groove 73 of rotor dovetail 71, are also provided with notch blade 10, so that above-described improvements, with reference to FIG. 14 exemplifying the adjacent notch blade 30, can be obtained with the notch blade 10.

The effective blade portion 13 and the bucket dovetail 15 are described below on their length in the radial direction.

The length h2 in the radial direction of the bucket dovetail 15 of the notch blade 10 (see FIG. 11) is configured to be shorter than the length h3 in the radial direction of the effective blade portion 13 of the adjacent notch blade 30 (see FIG. 13) and the length h4 in the radial direction of the bucket dovetail 15 (see FIG. 13).

As described above, the turbine rotor blades of the turbine rotor blade assembly 1 according to the embodiment are configured such that the length h2 in the radial direction of the bucket dovetail 15 of the notch blade 10 is shorter than the length h3 in the radial direction of the effective blade portion 13 of the adjacent notch blade 30.

Figure 15:
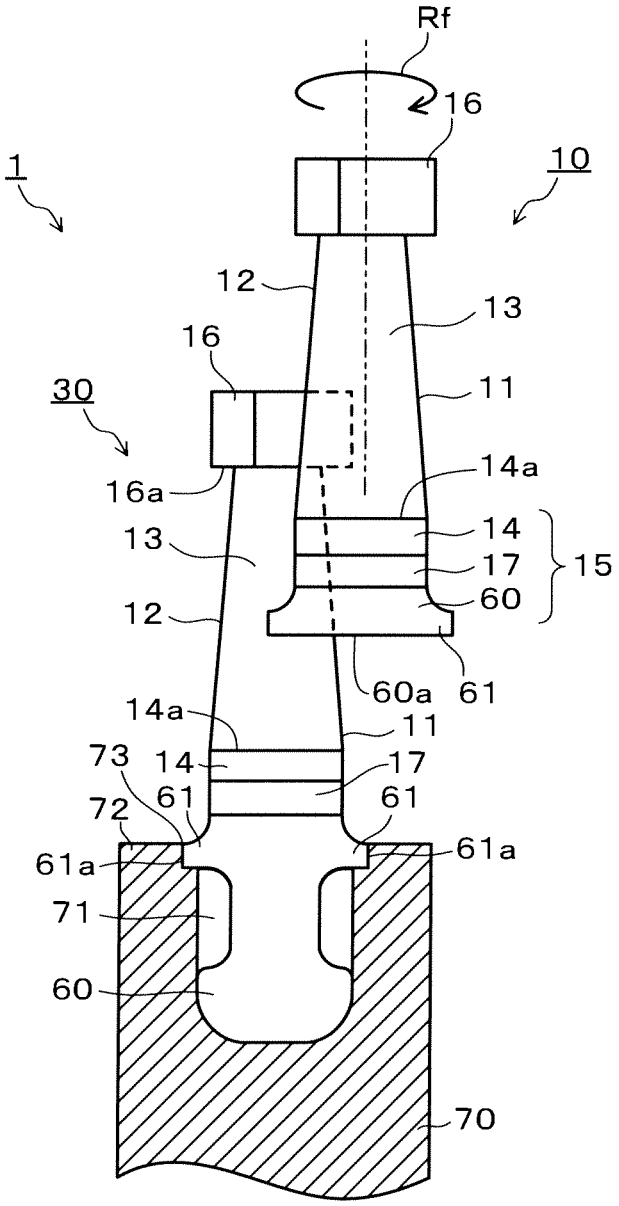
FIG. 15 is a plan view of a state of inserting the notch blade in a process of assembling the turbine rotor blade assembly of the second embodiment viewed from the circumferential direction of the turbine rotor.
Figure 16:
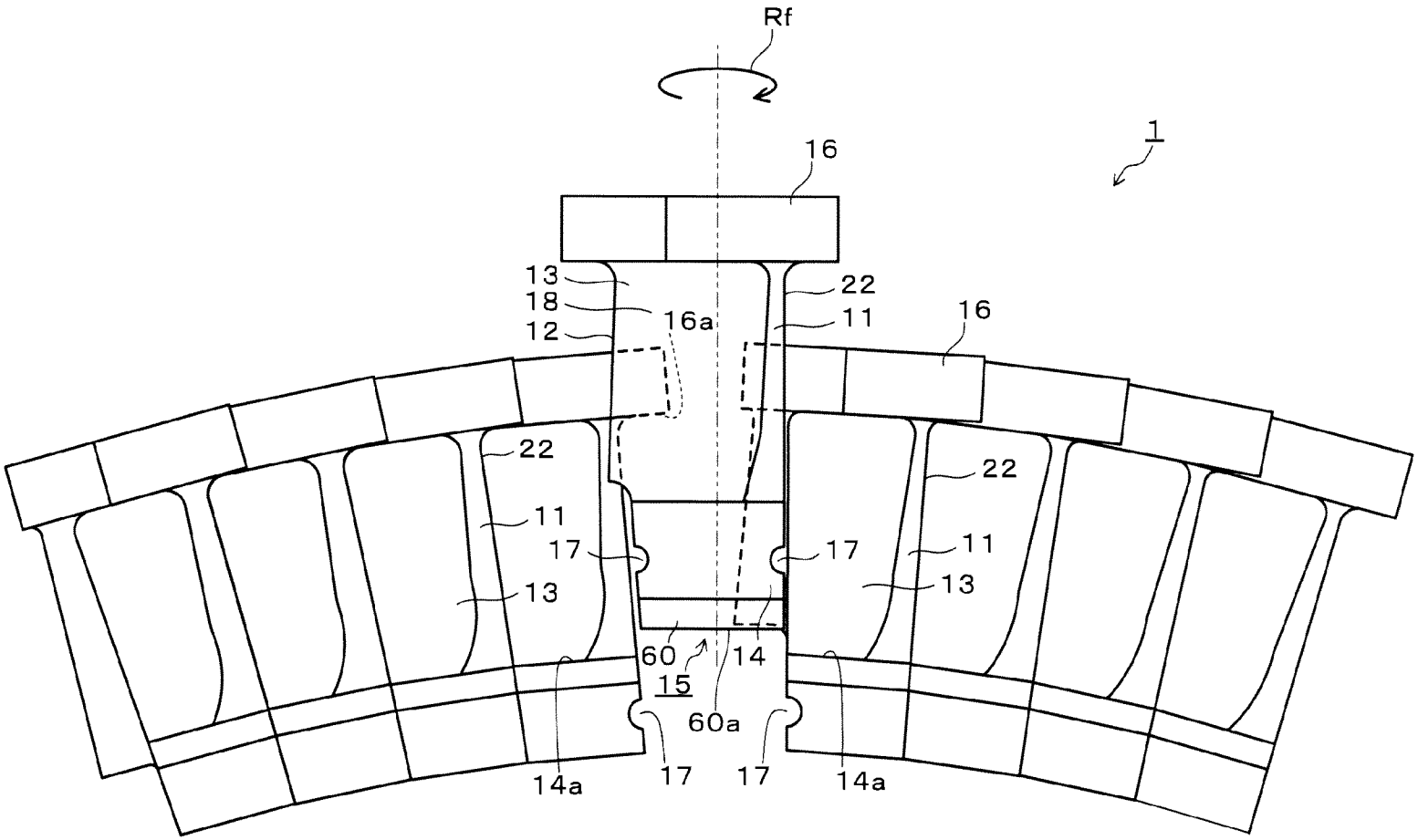
FIG. 16 is a plan view of a state of inserting a notch blade in a process of assembling the turbine rotor blade assembly of the second embodiment viewed from an upstream side of working fluid in the axial direction of the turbine rotor.

FIG. 15 is a plan view of a state of inserting the notch blade 10 in a process of assembling the turbine rotor blade assembly 1 of the second embodiment viewed in the circumferential direction. The turbine wheel 70 (turbine rotor) in FIG. 15 is shown as a cross section (meridional cross section) including a turbine rotor axis at a circumferential position of the inserting portion. FIG. 16 is a plan view of a state of inserting the notch blade 10 in a process of assembling the turbine rotor blade assembly 1 of the second embodiment viewed from an upstream side of working fluid in the axial direction.

As shown in FIG. 15 and FIG. 16, when a radial position of a top end 14*a* of the bucket dovetail 15 (solid portion 14) of the notch blade 10 is located inside with respect to the inner surface 16*a* of the cover portion 16 of the adjacent notch blade 30, the notch blade 10 is inserted in the axial direction into the space between the already implanted adjacent notch blades 30. And, when the notch blade 10 has reached a final position (a proper and predetermined position) in the axial direction, the notch blade 10 is inserted vertically (i.e. radially) in the radial direction. Thus, the turbine rotor blade assembly 1 is relatively easily assembled by inserting the notch blade 10 and inserting the stop key into the key hole, which is formed by the key grooves 17 of the notch blade 10 and the adjacent notch blade 30, for fixation.

Here, when the radial position of the top end 14*a* of the bucket dovetail 15 (solid portion 14) of the notch blade 10 is located inside with respect to the inner surface 16*a* of the cover portion 16 of the adjacent notch blade 30, the radial direction of a lower end 60*a* of the bucket dovetail 15 of the notch blade 10 is located outside with respect to the top end 14*a* of the bucket dovetail 15 (solid portion 14) of the adjacent notch blade 30 because the length h2 of the bucket dovetail 15 of the notch blade 10 is configured to be shorter than the length h3 of the effective blade portion 13 of the adjacent notch blade 30. Thus, when the notch blade 10 is inserted in the axial direction, a rotational movement Rf around the radial direction and a circumferential movement of the notch blade 10 can be secured.

Therefore, during the insertion of the notch blade 10 in the axial direction, the interference between the trailing edge 12 of the notch blade 10 and the cover portion 16 of the adjacent notch blade 30 located on the pressure side 18 of the notch blade 10 can be prevented. The interference between the leading edge 11 of the notch blade 10 and the cover portion 16 of the adjacent notch blade 30 located on the suction side 22 of the notch blade 10 can also be prevented during the insertion of the notch blade 10.

In the adjacent notch blade 30, the length h3 of the effective blade portion 13 may be shorter than the length h4 of the bucket dovetail 15. The blade cascade which has the length h3 of the effective blade portion 13 configured to be shorter than the length h4 of the bucket dovetail 15, for example, is applied to a turbine blade cascade arranged at an upstream side of working fluid, such as a first-stage rotor blades assembly or the like, of the steam turbine. For these rotor blade assemblies, into which the notch blade is sometimes difficult to be inserted, the structure of the turbine rotor blade assembly of the second embodiment can be applied and improve its assemblability.

Here, a gap is formed between the lower end 60*a* of the bucket dovetail 15 of the notch blade 10 and a bottom surface of the rotor dovetail 71 of the turbine wheel 70. So, it may be configured to provide a filling member, as a spacer member, with the gap.

Figure 17:
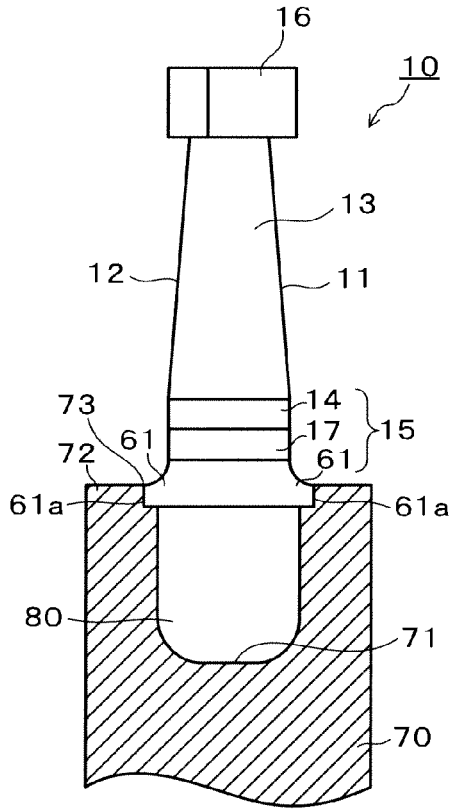
FIG. 17 is a plan view of a notch blade which is implanted in the turbine wheel of the turbine rotor with a filling member viewed from the circumferential direction of the turbine rotor.
Figure 18:
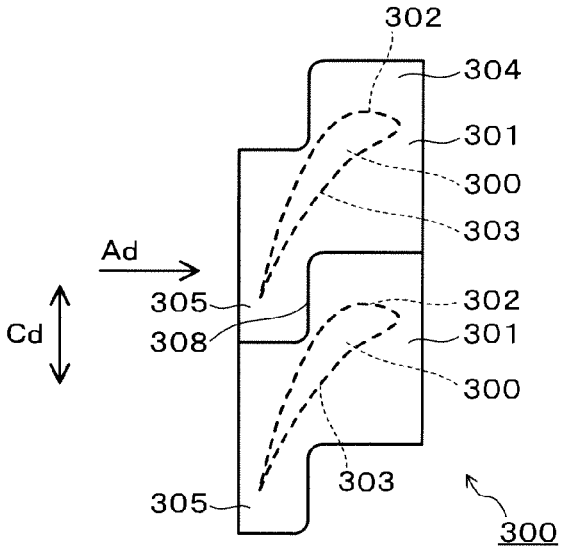
FIG.18 Prior Art
FIG. 18 is a plan view of an assembled turbine rotor blades having a snubber cover structure viewed from the cover side.
Figure 19:
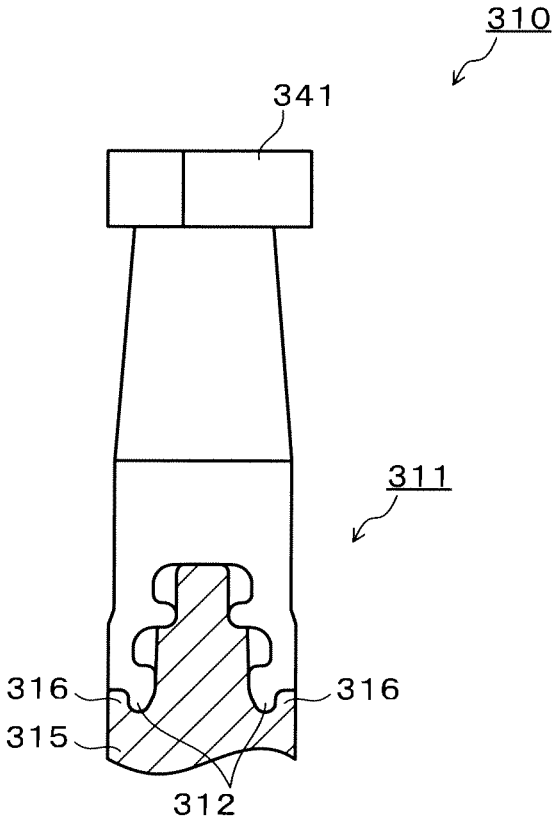
FIG.19 Prior Art
FIG. 19 is a side view of a turbine rotor blade having a twist lock structure.

FIG. 17 is a plan view of the notch blade 10, which is implanted in the turbine wheel 70 of the turbine rotor with a filling member 80, viewed from the circumferential direction of the turbine rotor. As shown in FIG. 17, the filling member 80 may be arranged in the gap between the lower end of the bucket dovetail 15 of the notch blade 10 and the bottom surface of the rotor dovetail 71 of the turbine wheel 70.

Thus, filling member 80 can suppress the turbine rotor blade of the turbine rotor blade assembly 1 from becoming loose in the circumferential direction.

As described above, the turbine rotor blade assembly 1 and steam turbine of the second embodiment can have the length h2 in the radial direction of the bucket dovetail 15 of the notch blade 10 configured to be shorter than the length h3 in the radial direction of the effective blade portion 13 of the adjacent notch blade 30 and the length h4 in the radial direction of the bucket dovetail 15. Thus, when the notch blade 10 is inserted in the axial direction, the rotational movement Rf around the radial direction and the circumferential movement of the notch blade 10 can be secured.

Therefore, when the notch blade 10 is inserted in the axial direction, the interference between the trailing edge 12 of the notch blade 10 and the cover portion 16 of the adjacent notch blade 30 located on the pressure side 18 of the notch blade 10 can be prevented. The interference between the leading edge 11 of the notch blade 10 and the cover portion 16 of the adjacent notch blade 30 located on the suction side 22 of the notch blade 10 can also be prevented during the insertion of the notch blade 10. Thus, according to the turbine rotor blade assembly 1 and steam turbine according to the second embodiment, the assemblability of the notch blade 10 can be improved while ensuring the structural reliability of the turbine rotor blades of the steam turbine.

As described above, according to the turbine rotor blade assembly and a steam turbine according to the embodiments, the assemblability of the notch blade can be improved while ensuring the structural reliability of the turbine rotor blades. While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A turbine rotor blade assembly, comprising:

a turbine rotor; and a plurality of turbine rotor blades implanted on the turbine rotor in a circumferential direction, the turbine rotor blades including a notch blade to be implanted last among the turbine rotor blades on the turbine rotor and an adjacent notch blade to be implanted adjacent to the notch blade, each of the turbine rotor blades comprising:

an effective blade portion;

a tangential type bucket dovetail disposed at a root portion of the effective blade portion; and a cover portion integrally formed on a tip of the effective blade portion, the cover portion mutually contacting an adjacent cover portion, the cover portion comprising a pressure-side overhanging portion protruded in the circumferential direction at a trailing edge side of the turbine rotor blade and a suction-side overhanging portion protruded in the circumferential direction at a leading edge side of the turbine rotor blade, wherein a length in a radial direction of a bucket dovetail of the notch blade is shorter than a length in the radial direction of the effective blade portion of the adjacent notch blade, and the length in the radial direction of the bucket dovetail of the notch blade is shorter than a length in the radial direction of the bucket dovetail of the adjacent notch blade, and wherein the length in the radial direction of the effective blade portion of the adjacent notch blade is shorter than the length in the radial direction of the bucket dovetail of the adjacent notch blade.

2. The turbine rotor blade assembly according to claim 1, wherein the turbine rotor blades disposed mutually adjacent in the circumferential direction have a side surface of the pressure-side overhanging portion contacted to a side surface of the suction-side overhanging portion of the turbine rotor blade adjacent thereof.

3. The turbine rotor blade assembly according to claim 1, wherein the bucket dovetail of the turbine rotor blades other than the notch blade comprises a saddle-shaped leg portion branched into two in the radial direction and a protruded portion formed along the circumferential direction at both root ends of the saddle-shaped leg portion; and wherein the turbine rotor comprises a rotor dovetail for receiving the bucket dovetails of the turbine rotor blades with a cutout groove fitted into the protruded portion formed along the circumferential direction.

4. The turbine rotor blade assembly according to claim 1, further comprising a spacer member disposed in a space between an end portion of the bucket dovetail of the notch blade and an end portion of a rotor dovetail of the turbine rotor for receiving the notch blade.

5. A steam turbine, comprising the turbine rotor blade assembly according to claim 1.

6. The turbine rotor blade assembly according to claim 2, wherein the bucket dovetail of the turbine rotor blades other than the notch blade comprises a saddle-shaped leg portion branched into two in the radial direction and a protruded portion formed along the circumferential direction at both root ends of the saddle-shaped leg portion; and wherein the turbine rotor comprises a rotor dovetail for receiving the bucket dovetails of the turbine rotor blades with a cutout groove fitted into the protruded portion formed along the circumferential direction.

7. The turbine rotor blade assembly according to claim 2, further comprising a spacer member disposed in a space between an end portion of the bucket dovetail of the notch blade and an end portion of a rotor dovetail of the turbine rotor for receiving the notch blade.

8. A steam turbine, comprising the turbine rotor blade assembly according to claim 2.

* * * * *